US009315937B2

(12) United States Patent
Gedanken et al.

(10) Patent No.: US 9,315,937 B2
(45) Date of Patent: Apr. 19, 2016

(54) SONOCHEMICAL COATING OF TEXTILES WITH METAL OXIDE NANOPARTICLES FOR ANTIMICROBIAL FABRICS

(75) Inventors: Aharon Gedanken, Givataim (IL); Yeshayahu Nitzan, Givat Shmuel (IL); Ilana Perelshtein, Rishon le Zion (IL); Nina Perkas, Petach Tikva (IL); Guy Applerot, Ramat Gan (IL)

(73) Assignee: BAR-ILAN UNIVERSITY, Ramat Gan (IL)

( * ) Notice: Subject to any disclaimer, the term of this patent is extended or adjusted under 35 U.S.C. 154(b) by 320 days.

(21) Appl. No.: 12/997,276

(22) PCT Filed: Jun. 29, 2009

(86) PCT No.: PCT/IL2009/000645

§ 371 (c)(1),
(2), (4) Date: Dec. 10, 2010

(87) PCT Pub. No.: WO2010/001386

PCT Pub. Date: Jan. 7, 2010

(65) Prior Publication Data

US 2011/0097957 A1 Apr. 28, 2011

Related U.S. Application Data

(60) Provisional application No. 61/129,472, filed on Jun. 30, 2008.

(51) Int. Cl.
*A61K 9/70* (2006.01)
*B32B 27/14* (2006.01)
(Continued)

(52) U.S. Cl.
CPC ..... *D06M 11/42* (2013.01); *D06M 10/02* (2013.01); *D06M 11/44* (2013.01); *D06M 16/00* (2013.01); *Y10T 442/2525* (2015.04)

(58) Field of Classification Search
CPC ..... C08F 2/56; G03G 9/08; A61K 9/70; B32B 27/14
USPC ..... 424/443, 404; 442/128; 427/560; 977/961; 8/115.51
See application file for complete search history.

(56) References Cited

U.S. PATENT DOCUMENTS 4,207,071 A 6/1980 Lipowitz et al.
5,466,722 A * 11/1995 Stoffer et al. ..... 522/51
(Continued)

FOREIGN PATENT DOCUMENTS

CN 1807750 7/2006
WO 2007032001 3/2007
WO WO2007058297 * 5/2007

OTHER PUBLICATIONS

International Search Report dated Nov. 13, 2009 in corresponding application PCT/IL2009/000645.
(Continued)

*Primary Examiner* — Vasu Jagannathan
*Assistant Examiner* — Preeti Kumar
(74) *Attorney, Agent, or Firm* — Symbus Law Group, LLC; Clifford D. Hyra

(57) ABSTRACT

We disclose a system for preparing antimicrobial fabrics, coated with metal oxide nanoparticles by means of a novel sonochemical method. These antibacterial fabrics are widely used for production of outdoor clothes, under-wear, bed-linen, bandages, etc. The deposition of metal oxides known to possess antimicrobial activity, namely ZnO, MgO and CuO, can significantly extent the applications of textile fabrics and prolong the period of their use. By means of the novel sonochemical method disclosed here, uniform deposition of metal oxide nanoparticles is achieved simply.

17 Claims, 6 Drawing Sheets

(51) Int. Cl.

| | |
|---|---|
| ***C08F 2/56*** | (2006.01) |
| ***D06M 11/42*** | (2006.01) |
| ***D06M 10/02*** | (2006.01) |
| ***D06M 11/44*** | (2006.01) |
| ***D06M 16/00*** | (2006.01) |

(56) References Cited

U.S. PATENT DOCUMENTS

| | | | | |
|---|---|---|---|---|
| 5,656,037 | A | 8/1997 | Vigo et al. | |
| 7,824,768 | B2 * | 11/2010 | Shan et al. | 428/370 |
| 2003/0017336 | A1 | 1/2003 | Gedanken et al. | |
| 2005/0085144 | A1 | 4/2005 | MacDonald et al. | |
| 2006/0021642 | A1 | 2/2006 | Sliwa, Jr. et al. | |
| 2006/0141015 | A1 * | 6/2006 | Tessier et al. | 424/443 |
| 2007/0054577 | A1 | 3/2007 | Avloni | |

OTHER PUBLICATIONS

EP Search Report that issued on Feb. 24, 2015 that issued in EP 2294260 A1.

* cited by examiner

SONOCHEMICAL COATING OF TEXTILES WITH METAL OXIDE NANOPARTICLES FOR ANTIMICROBIAL FABRICS

FIELD OF THE INVENTION

The present invention relates to a system for preparing antimicrobial fabrics, coated with metal oxide nanoparticles by a novel sonochemical method.

BACKGROUND OF THE INVENTION

Antibacterial fabrics are widely used for production of outdoor clothes, under-wear, bed-linen, and bandages. Antimicrobial resistance is very important in textile materials, having effects amongst others on comfort for the wearer. The deposition of metal oxides known to possess antimicrobial activity, namely ZnO, MgO and CuO, can significantly extent the applications of textile fabrics and prolong the period of their use.

Zinc oxide has been recognized as a mild antimicrobial agent, non toxic wound healing agent, and sunscreen agent. Because it reflects both UVA and UVB rays, zinc oxide can be used in ointments, creams and lotions to protect against sunburn and other damage to the skin caused by ultraviolet lights [Godfrey H. R. Alternative Therapy Health Medicine, 7 (2001) 49]. At the same time ZnO is an inorganic oxide stable against temperatures encountered in normal textile use, contributing to its long functional lifetime without color change or oxidation. The antibacterial properties of MgO and CuO nanoparticles were also demonstrated [*Controllable preparation of Nano-MgO and investigation of its bactericidal properties*. Huang L., Li D. Q, Lin Y. J., Wei M., Evans D. G., Duan X. L. Inorganic Biochemistry, 99 (2005) 986, and *Antibacterial Vermiculite Nano-Material*. Li B., Yu S., Hwang J. Y., Shi S. Journal of Minerals & Materials Characterization & Engineering, 1 (2002) 61].

An antimicrobial formulation containing ZnO powder, binding agent, and dispersing agent was used to protect cotton and cotton-polyester fabrics ["Microbial Detection, Surface Morphology, and Thermal Stability of Cotton and Cotton/Polyester Fabrics Treated with Antimicrobial Formulations by a Radiation Method". Zohby M. H., Kareem H. A., El-Naggar A. M., Hassan, M. S., J. Appl. Polym. Sci. 89 (2003) 2604] This formulation was applied to fabrics under high energy radiation of Co-60 γ or electron beam irradiation and then subjected for fixation by thermal treatment. A superior antimicrobial finish was achieved with cotton fabrics containing 2 wt % ZnO and with cotton-polyester fabrics containing 1 wt % ZnO. The particle size of ZnO in these samples according to SEM measurement was 3-5 μm. In spite of good antimicrobial activity, the disadvantages of this method are the use of additional binding and dispersing agent, and requirements of high energy radiation and an additional stage of thermal curing. It was also reported that ZnO-soluble starch nanocomposite was impregnated onto cotton fabrics to impart antibacterial and UV-protection functions with ZnO concentration 0.6-0.8 wt % [*Functional finishing of cotton fabrics using zinc oxide-soluble starch nanocomposites*. Vigneshwaran N., Kumar S., Kathe A. A., Varadarajan P., Prasad V., Nanotechnology 17 (2006) 5087]. The particle size of ZnO in zinc oxide-starch composition was reported as 38 nm. However, in this work the special stabilizing agent, namely, acrylic binder is used which should undergo the additional stage of polymerization at 140° C.

Hence, an improved method of dispersion metal oxide nanoparticles onto textiles is still a long felt need.

BRIEF DESCRIPTION OF THE DRAWINGS

In order to understand the invention and to see how it may be implemented in practice, a plurality of embodiments will now be described, by way of non-limiting example only, with reference to the accompanying drawings, in which.

SUMMARY OF THE INVENTION

Figure 1:
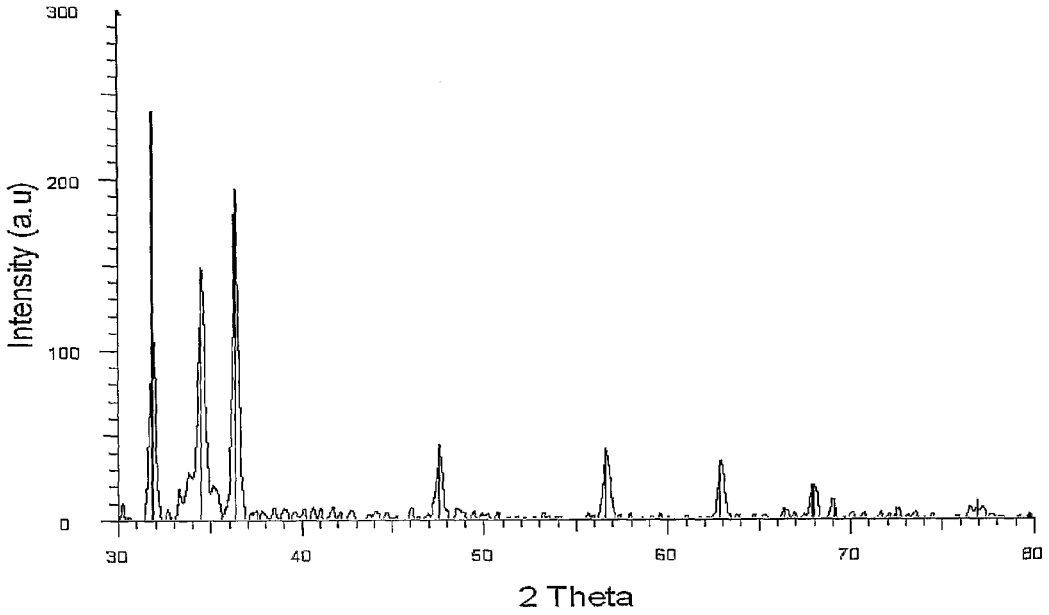
FIG. 1 presents an XRD pattern indicating hexagonal phase of ZnO matching PDF file: 89-7102.

The present invention comprises a system and method for sonochemical dispersion of metal oxide nanoparticles onto textiles.

It is within the core of the present invention to provide a method for ultrasonic impregnation of textiles with metal oxide nanoparticles consisting of steps of:

a. preparing a water-ethanol solution;
b. adding $M(Ac)_2$ to said solution, forming a mixture;
c. immersing said textiles in said mixture;
d. adjusting the pH of said mixture to basic pH by means of addition of aqueous ammonia;
e. purging said mixture to remove traces of $CO_2$/air;
f. irradiating said mixture with a high intensity ultrasonic power;
g. washing said textile with water to remove traces of ammonia;
h. further washing said textile with ethanol, and drying in air.

thereby producing a textile—metal oxide composite containing homogeneously impregnated metal oxide nanoparticles, without use of electromagnetic radiation.

It is further within provision of the invention to provide the aforementioned method where said water-ethanol solution is in a ratio of approximately 1:9.

It is further within provision of the invention to provide the aforementioned method where $M(Ac)_2$ is added in a concentration of between 0.002 and 0.02 M.

It is further within provision of the invention to provide the aforementioned method where M is selected from a group consisting of metals Zn, Mg, Cu.

It is further within provision of the invention to provide the aforementioned method where said basic pH is approximately 8.

It is further within provision of the invention to provide the aforementioned method where said step of purging is carried out with argon for 1 hour.

It is further within provision of the invention to provide the aforementioned method where said step of irradiating said mixture is carried out for 1 hour It is further within provision of the invention to provide the aforementioned method where said step of irradiating said mixture is carried out by means of an ultrasonic horn It is further within provision of the invention to provide the aforementioned method where said step of irradiating said mixture is carried out using ultrasonic waves at a frequency of approximately 20 kHz.

It is further within provision of the invention to provide the aforementioned method where said step of irradiating said mixture is carried out using ultrasonic waves at a power of approximately 1.5 kW It is further within provision of the invention to provide the aforementioned method where said step of irradiating said mixture is carried out under a flow of argon It is further within provision of the invention to provide the aforementioned method where said step of irradiating said mixture is carried out at approximately 30° C.

It is further within provision of the invention to provide the aforementioned method where said textile composite contains between 0.1 wt % and 10 wt % of metal oxide (MO).

It is further within provision of the invention to provide the aforementioned method where MO nanocrystals are between 10 nm and 1000 nm in diameter.

It is further within provision of the invention to provide textiles imparted with bacteriostatic properties by means of ultrasonic irradiation of said textiles in an aqueous metal oxide mixture, thereby attaining uniform impregnation of said textiles with metal oxide nanoparticles.

According to another embodiment of the present invention, when commercial MO nanoparticles are introduced in the sonication mixture or MO nanoparticles commercially available (prepared by another method and not sonochemically). The ultrasound can still be used for "throwing stones" at the fabric surface, and good antibacterial properties are obtained.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF PREFERRED EMBODIMENTS

The following description is provided, alongside all chapters of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a means and method for providing a wood-resin composite.

In the following detailed description, numerous specific details are set forth in order to provide a thorough understanding of embodiments of the present invention. However, those skilled in the art will understand that such embodiments may be practiced without these specific details. Reference throughout this specification to "one embodiment" or "an embodiment" means that a particular feature, structure, or characteristic described in connection with the embodiment is included in at least one embodiment of the invention.

The term 'sonochemical irradiation' hereinafter refers to exposure to sonic power, generally in the ultrasonic range of frequencies.

The term 'sonochemistry' refers to the study or use of sonochemical irradiation.

The term 'nanoparticles' hereinafter refers to particles of size ranging from about 10 micrometers to about 10 nanometers.

The term 'oxide' hereinafter refers to any inorganic oxide such as ZnO, MgO, CuO, and the like. In the following when ZnO is used specifically, it is used in exemplary fashion and can be replaced by any oxide as will be obvious to one skilled in the art.

The term 'plurality' refers hereinafter to any positive integer e.g, 1, 5, or 10.

It is within provision of the instant invention to offer a new process for preparation of textiles impregnated with nanometric oxide particles. The sonochemical method is applied for the deposition of ZnO nanocrystals on textile materials to impart them excellent antimicrobial activity. A comparison of the suggested ZnO-textile nanocomposite shows a clear advantage of the ultrasound radiation over all other available methods as will be described below.

We have demonstrated that sonochemical irradiation is a suitable method for synthesis of nanomaterials, and their deposition/insertion on/into ceramic and polymer supports. One of the many advantages demonstrated for sonochemistry is that a homogeneous dispersion of the nanoparticles on the surface of the substrate is achieved in one step. In this step the nanoparticles of the desired products are formed and accelerated onto/into the surface or body of the polymer or ceramics via microjets or shock waves that are created when a sonochemically produced bubble collapses near a solid's surface. The current patent is based on the work done by the inventors—see *The Preparation of Metal-Polymer Composite Materials using Ultrasound Radiation*, S. Wizel, R. Prozorov, Y. Cohen, D. Aurbach, S. Margel, A. Gedanken. J. Mater. Res. 13, (1998) 211; *Preparation of amorphous magnetite nanoparticles embedded in polyvinylalcohol using ultrasound radiation*". R. Vijaykumar, Y. Mastai, A. Gedanken, Y. S. Cohen, Yair Cohen, D. Aurbach, J. Mater. Chem. 10 (2000) 1125; *Sonochemical Deposition of Silver Nanoparticles on Silica Spheres* V. G. Pol, D. Srivastava, O. Palchik, V. Palchik, M. A. Slifkin, A. M. Weiss. A. Gedanken, Langmuir, 18, (2002) 3352; *Synthesis and Characterization of Zinc Oxide-PVA Nanocomposite by Ultrasound Irradiation and the Effect of the Crystal Growth of the Zinc Oxide"* R. Vijayakumar, R. Elgamiel, O. Palchik, A. Gedanken, J. Crystal Growth and Design, 250 (2003) 409; *Sonochemical Deposition of Silver Nanoparticles on Wool Fibers*. L. Hadad, N. Perkas, Y. Gofer, J. Calderon-Moreno, A. Ghule, A. Gedanken, J. Appl. Polym. Sci. 104 (2007)1732. These publications studied the deposition of large variety of nanoparticles on different kinds of substrates. The deposition was conducted either with materials that were dissolved in the irradiated solution or dispersed (not dissolved) in the solution.

The use of the sonochemical method helps to achieve all the principal requirements of the antimicrobial textile coated with nanomaterials: small particle size, regular shape, and homogeneous distribution of ZnO nanoparticles on the fabrics. Amongst the advantages of using ultrasound over other methods is that ultrasonic shockwaves effectively blast the oxide nanocrystals onto a fabric's surface at such speed that it causes local melting of the substrate, guaranteeing firm embedding of the nanocrystals within the textile fibers. Textiles sonochemically impregnated with ZnO displays outstanding antimicrobial activity in the case of both gram-positive and gram-negative bacteria.

An experimental procedure was developed as follows for testing and evaluation purposes. Other routes will be obvious to one skilled in the art, and the following is provided only by way of example.

PREPARATION PROCEDURE

1. A textile sample (such as a cotton square of about 100 $cm^2$) is placed in a 0.002-0.02 M solution of $M(Ac)_2$, (where M stands for metals Zn, Mg, Cu; and Ac stands for acetate ion) in a water:ethanol (1:9) solution.
2. The pH is adjusted to 8 with an aqueous solution of ammonia.
3. The reaction mixture is then purged with argon for 1 hour in order to remove traces of $CO_2$/air.
4. The solution is irradiated for 1 hour with a high intensity ultrasonic horn (Ti-horn, 20 kHz, 1.5 kW at 70% efficiency) under a flow of argon at 30° C.
5. The textile is washed thoroughly with water to remove traces of ammonia, then further washed with ethanol and dried in air.

It is also within provision of the invention to prepare the metal solutions as above using metal nitrates or other salts, as will be obvious to one skilled in the art.

As will also be obvious to one skilled in the art, the coating process can be accomplished without producing nanoparticles 'in house', by adding nanoparticles obtained by some other means to solution and ultrasonically treating as above in steps 2-5. The yield (amount of nanoparticles on the textile) in this case would be lower but enough to get antibacterial properties.

RESULTS

A sample coated by the above process with MO was tested for its antibacterial properties with gram-positive (*S. aureusa*) and gram-negative (*E. coli*) cultures. Antibacterial effects were shown in treated textiles even at a coating concentration of less than 1%, for all metal oxides mentioned above (Zn, Mg, Cu). We observed 98% reduction of the two strains of the bacteria after 1 hour.

Our experiments have also demonstrated that antibacterial treatment of ZnO coated bandages can increase the sensitivity of bacteria cells to two kinds of antibiotics; a 43% additional reduction in colonies was detected for Chloramphenicol due to the metal oxide and 34% for Ampicillin. The concentrations of antibiotics used in these experiments were much lower than those normally expected to cause any significant change in the bacteria growth. Thus, our results indicate a cooperative or synergic effect of metal oxide textile impregnation and antibiotic treatment.

The textile composite so produced contains on the order of 1 wt % of metal oxide (MO). The MO nanocrystals are of size ~150 nm, and are homogeneously distributed on the surfaces of the textile fibers.

The metal oxide concentration in the fabrics prepared as above can be varied in the range 0.5-10.0%.

Figure 2:
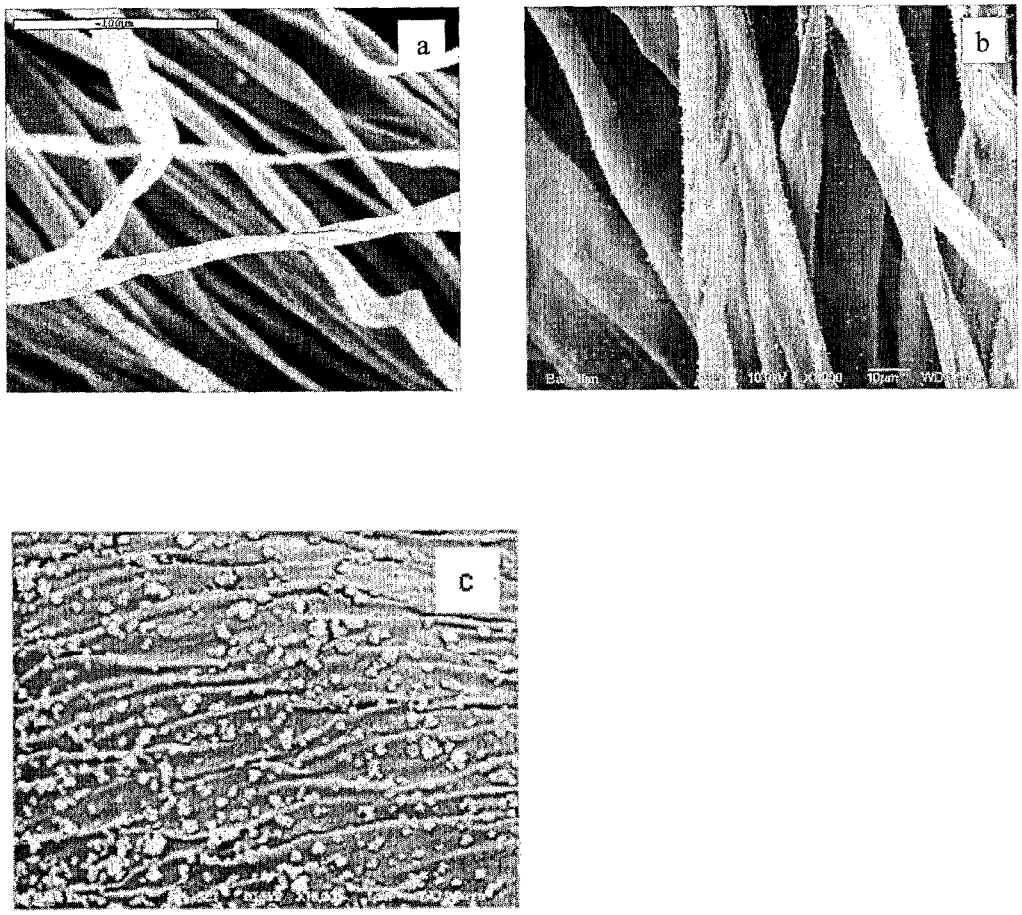
FIG. 2A-C presents HR SEM images of the fabric coated with ZnO: a—before coating, b—after coating, c—high magnification of figure b.
Figure 3:
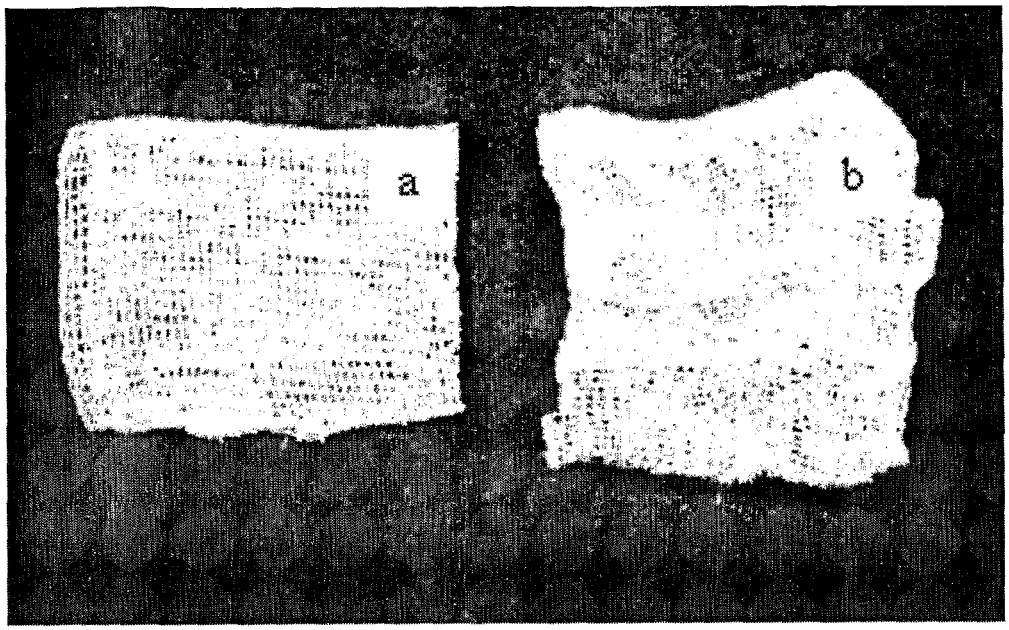
FIG. 3A, B present images of fabric coated with ZnO: a—before coating, b—after coating.

We now refer to FIG. 1 which displays XRD patterns of fabrics coated with zinc oxide, confirming the presence of ZnO nanocrystals. The homogeneous distribution of ZnO nanocrystals on the textile fibers was demonstrated in high-resolution SEM micrographs (FIG. 2). After sonochemical deposition of ZnO nanocrystals on the fabrics the color and texture of the material didn't change (FIG. 3).

Figure 4A:
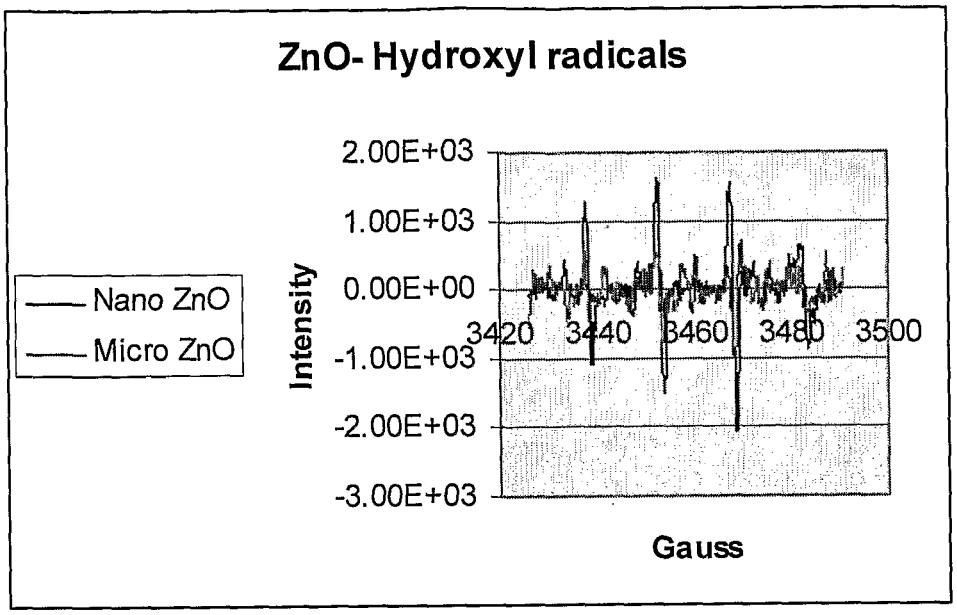
FIG. 4A, B presents a Comparing hydroxyl radicals generated from microscale and nanoscale ZnO, using DMPO as a spin-trapping agent and Theoretical (Computer) simulation of the ESR spectrum of hydroxyl radicals.
Figure 4B:
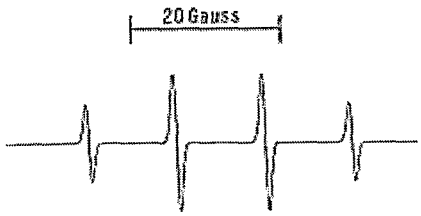

As is known in the art, the existence of free radicals can aid in destruction of bacteria. In our investigation, the generation of both active oxygen species ($O_2^-$ and OH.) from the ZnO powder was demonstrated using ESR measurements. Moreover, we found that at the nanoscale regime of ZnO particle size, the amount of the generated OH. was considerably higher than that of the microscale size, probably due to a higher specific surface area of the smaller particles (FIG. 4). Similar spectra were obtained when a piece of ZnO-cotton coated bandage was introduced in the ESR tube. These results are in good agreement with the measured influence of particle size on the antibacterial activity of ZnO powders, as it was found that the antibacterial activity of ZnO increased with decreasing particle size. This is supported by the following table of results measuring bacteria reduction for two bacteria types (*E. coli* and *S. aureusa*) after various treatment times, for different particle sizes of ZnO crystallites. Sample ZnO-1 has diameter ~8 nm, sample ZnO-2 has diameter ~275 nm, and sample ZnO-3 has diameter ~600 nm.

TABLE 1 bacteria population reduction for different grainsizes and treatment times.

| | | *E. coli* | | | *S. aureus* | | |
|---|---|---|---|---|---|---|---|
| Sample | Duration of treatment [h] | [CFU $mL^{-1}$] | $N/N_0$ | % Reduction in viability | [CFU $mL^{-1}$] | $N/N_0$ | % Reduction in viability |
| ZnO-1 | 0 | $6.5 \times 10^7$ | 1 | 0 | $1.2 \times 10^7$ | 1 | 0 |
| | 1 | $5.2 \times 10^6$ | $8.0 \times 10^{-2}$ | 92 | $3.5 \times 10^6$ | $2.9 \times 10^{-1}$ | 21 |
| | 2 | $6.5 \times 10^5$ | $1.0 \times 10^{-2}$ | 99 | $2.0 \times 10^6$ | $1.7 \times 10^{-1}$ | 83 |
| | 3 | $1.3 \times 10^3$ | $2.0 \times 10^{-3}$ | 99.8 | $2.4 \times 10^5$ | $2.0 \times 10^{-2}$ | 98 |
| ZnO-2 | 0 | $6.5 \times 10^7$ | 1 | 0 | $1.2 \times 10^7$ | 1 | 0 |
| | 1 | $10 \times 10^7$ | $1.6 \times 10^{-1}$ | 84 | $6.4 \times 10^6$ | $5.3 \times 10^{-1}$ | 47 |
| | 2 | $3.3 \times 10^6$ | $5.1 \times 10^{-2}$ | 95 | $4.1 \times 10^6$ | $3.4 \times 10^{-1}$ | 66 |
| | 3 | $3.3 \times 10^5$ | $2.0 \times 10^{-3}$ | 99.5 | $1.3 \times 10^6$ | $1.1 \times 10^{-1}$ | 89 |
| ZnO-3 | 0 | $6.5 \times 10^7$ | 1 | 0 | $1.2 \times 10^{-7}$ | 1 | 0 |
| | 1 | $2.0 \times 10^7$ | $3.1 \times 10^{-1}$ | 69 | $1.0 \times 10^7$ | $8.7 \times 10^{-1}$ | 13 |
| | 2 | $1.69 \times 10^7$ | $2.6 \times 10^{-1}$ | 74 | $8.2 \times 10^6$ | $5.8 \times 10^{-1}$ | 42 |
| | 3 | $8.5 \times 10^6$ | $21.3 \times 10^{-1}$ | 87 | $3.8 \times 10^6$ | $3.2 \times 10^{-1}$ | 68 |

Figure 6:
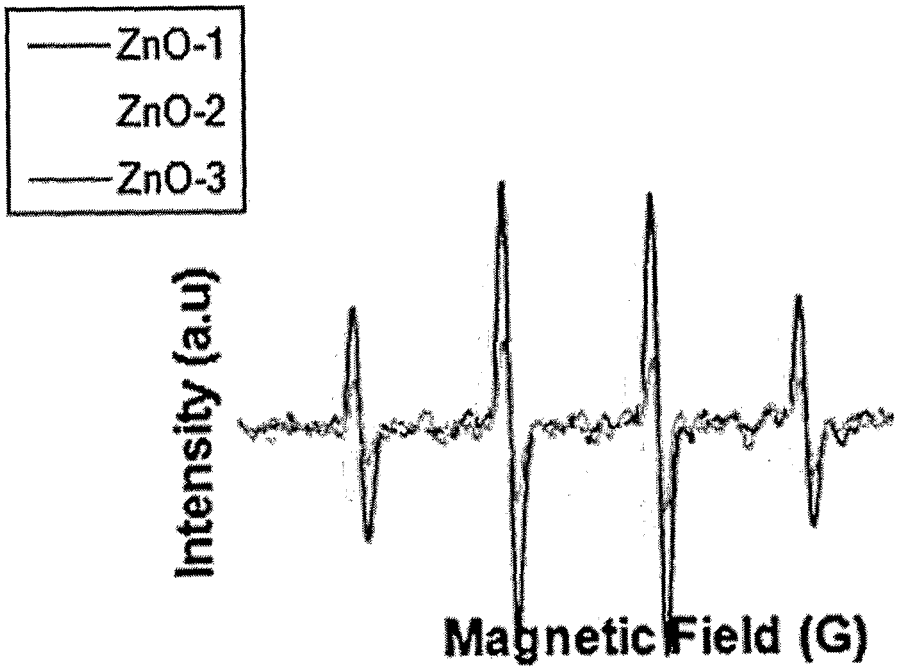
FIG. 6 presents ESR hydroxyl radical spectra of water suspensions with different ZnO samples, showing clearly that as the grain size decreases the hydroxyl signal increases.

As is clear from the table above, the bacteria populations are reduced with greater exposure time and smaller ZnO grain size. The above explanation for these results is further substantiated in FIG. 6 which presents ESR hydroxyl radical spectra of water suspensions with different ZnO samples, showing clearly that as the grainsize decreases the hydroxyl signal increases.

The textiles sonochemically impregnated with ZnO demonstrate high stability; the amount of ZnO remaining in the textile after 50 washing cycles remains constant. The stability of nanoparticles on the fabric was measured after 50 washing cycles by both TEM measurements, and titrating the fabric with EDTA to determine the amount of ZnO.

Figure 5:
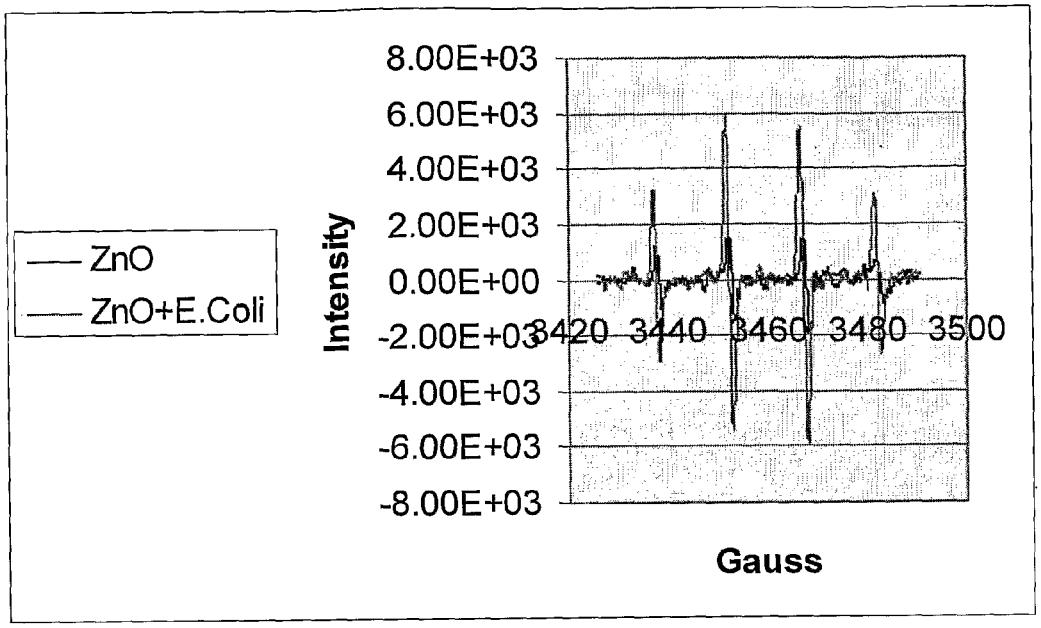
FIG. 5 presents the amount of the hydroxyl radicals in a medium containing both ZnO and bacteria.

In another experiment, we measured the amount of the hydroxyl radicals in a medium containing both ZnO and bacteria (*e. coli* and *s. aureusa* in saline). An enhancement of the amount of hydroxyl radicals could be detected comparing to samples without the bacteria (FIG. 5). We assume that this enhancement comes from an oxidative stress of the bacteria in a medium containing the ZnO.

The invention claimed is:

1. A method comprising:

immersing a textile in a mixture of metal acetate ($M(AC)_2$) added to a water-ethanol solution;

adjusting a pH of the mixture to a range of about 8-10 by adding aqueous ammonia; and ultrasonically irradiating the mixture via ultrasonic waves at a frequency of approximately 20 kHz, the ultrasonic waves (i) sonochemically causing bubbles to form in the mixture; and (ii) sonochemically causing the bubbles to collapse, wherein the collapsing of the bubbles:

create metal oxide (MO) nanoparticles from the $M(AC)_2$; and form microjets near fibers of the textile that embed the MO nanoparticles into the fibers of the textile.

2. The method of claim 1, wherein said water-ethanol solution is in a ratio of approximately 1:1 to approximately 1:9.

3. The method of claim 1, wherein M is selected from a group consisting of metals Zn, Mg, Cu and any combination thereof.

4. The method of claim 1, further comprising purging the mixture to remove traces of $CO_2$ or air.

5. The method of claim 1, wherein the irradiating is carried out for 1 hour.

6. The method of claim 1, wherein the irradiating is carried out by at least one selected from the group consisting of (a) an ultrasonic horn; (b) ultrasonic waves at a frequency of approximately 20 kHz; (c) ultrasonic waves at a power of approximately 1.5 kW; (d) a flow of argon; and (e) any combination thereof.

7. The method of claim 1, wherein the irradiating is carried out at approximately 30° C.

8. The method of claim 1, wherein the textile contains between 0.1 wt % and 10 wt % of metal oxide (MO).

9. The method of claim 4, wherein the purging is carried out with argon for 1 hour.

10. The method of claim 1, wherein a concentration of the metal acetate M(AC)2 is between 0.002 M to 0.02 M, and wherein the formed MO nanoparticles have diameters of between 1 nm and 1000 nm.

11. The method of claim 1, wherein the MO nanoparticles are embedded so that they are about equally distributed within the fibers.

12. The method of claim 1, wherein the method produces a textile having bacteriostatic and antibacterial properties.

13. The method of claim 1, further comprising:

a. removing the textile from the mixture;

b. removing ammonia from the textile by washing the textile with water; and c. washing the textile with ethanol.

14. The method of claim 6, wherein the irradiating is performed under a flow of argon.

15. A method, comprising:

immersing a textile in a mixture of metal acetate ($M(AC)_2$) added to a water-ethanol solution;

adjusting a pH of the mixture to a range of about 8-10 by adding aqueous ammonia; and ultrasonically irradiating the mixture via ultrasonic waves at a frequency of approximately 20 kHz, the ultrasonic waves (i) sonochemically causing bubbles to form in the mixture; and (ii) sonochemically causing the bubbles to collapse, wherein the collapsing of the bubbles form microjets near a surface of the textile that embed MO nanoparticles in the mixture into the fibers of the textile.

16. A method, comprising:

immersing a textile in a mixture of metal acetate ($M(AC)_2$) added to a water-ethanol solution;

forming metal oxide (MO) nanoparticles by adjusting a pH of the mixture to a range of about 8-10 by adding aqueous ammonia; and ultrasonically irradiating the mixture via ultrasonic waves at a frequency of approximately 20 kHz, the ultrasonic waves (i) sonochemically causing bubbles to form in the mixture; and (ii) sonochemically causing the bubbles to collapse, wherein the collapsing of the bubbles form microjets near a surface of the textile that embed the MO nanoparticles into the fibers of the textile.

17. A method, comprising:

immersing a textile in a mixture of metal acetate $M(AC)_2$ added to a water-ethanol solution;

adjusting a pH of the mixture to a range of about 8-10 by adding aqueous ammonia; and sonochemically forming bubbles in the mixture by ultrasonically irradiating the mixture with ultrasonic waves at a frequency of approximately 20 kHz; and sonochemically causing the bubbles to collapse so as form microjets near a surface of fibers of the textile, the microjets embedding MO nanoparticles in the mixture into fibers of the textile.

* * * * *